US006205611B1

(12) United States Patent
Vigil

(10) Patent No.: US 6,205,611 B1
(45) Date of Patent: Mar. 27, 2001

(54) TOOTH AND GUM CLEANING TOOL

(76) Inventor: Onesimo Vigil, 1146 Vuelta de las Acequias, Sante Fe, NM (US) 87505

( * ) Notice: Subject to any disclaimer, the term of this patent is extended or adjusted under 35 U.S.C. 154(b) by 0 days.

(21) Appl. No.: 09/282,925

(22) Filed: Apr. 1, 1999

(51) Int. Cl.[7] ..... A46B 15/00; A46B 17/06; A47L 1/09; A47L 7/04; A61H 13/00

(52) U.S. Cl. ..... 15/244.1; 15/104.92; 15/104.93; 15/104.94; 15/257.01; 132/308; 132/310; 206/209; 206/439; 422/292; 422/300; 601/141

(58) Field of Search ..... 15/104.92–104.94, 15/244.1, 257.01; 132/308, 310; 206/209, 209.1, 361, 362, 439; 422/292, 300; 601/141

(56) References Cited

U.S. PATENT DOCUMENTS

| | | | | |
|---|---|---|---|---|
| 1,194,540 | * | 8/1916 | Quartararo | 206/209.1 |
| 1,790,085 | * | 1/1931 | Barringer et al. | 206/209.1 |
| 1,924,337 | * | 8/1933 | Troupa | 15/244.1 |
| 2,159,295 | * | 5/1939 | Seifert | 15/244.1 |
| 2,736,917 | * | 3/1956 | Goldstein et al. | 15/104.94 |
| 2,783,491 | * | 3/1957 | Bellam | 15/244.1 |
| 2,860,011 | * | 11/1958 | Dunn | 15/244.1 X |
| 3,064,660 | * | 11/1962 | Munoz et al. | 15/244.1 X |
| 3,267,512 | * | 8/1966 | Wiley | 15/244.1 X |
| 3,458,268 | * | 7/1969 | Wozab et al. | 15/244.1 X |
| 3,590,414 | * | 7/1971 | Gores | 15/244.1 |
| 4,083,078 | * | 4/1978 | Shimizu | 15/244.1 |
| 4,214,657 | * | 7/1980 | Winston | 206/209.1 |
| 5,133,971 | * | 7/1992 | Copelan et al. | 15/244.1 X |
| 5,749,116 | * | 5/1998 | Wieder et al. | 15/160 |
| 5,960,801 | * | 10/1999 | Vermooten et al. | 206/209.1 X |

FOREIGN PATENT DOCUMENTS

| | | | | |
|---|---|---|---|---|
| 594466 | * | 9/1925 | (FR) | 422/300 |
| 727252 | * | 6/1932 | (FR) | 15/244.1 |
| 6-62923 | * | 3/1994 | (JP) | 15/244.1 |

* cited by examiner

*Primary Examiner*—Mark Spisich

(57) ABSTRACT

A tooth and gum cleaning tool for cleaning teeth and gums. The tooth and gum cleaning tool includes an elongate handle portion having first and second ends. A sponge portion is coupled to said first end of said handle portion. The sponge portion has an engaging face and a back face opposite the engaging face. The engaging face has a plurality of uniformly spaced ridges extending from it. Also disclosed is a sterilization device for sterilizing the tooth cleaning tool. The sterilization device comprises a housing that has an open top, a closed bottom, and an interior. A sterilizing pad is disposed in the interior of the housing and is porous and has a sterilizing fluid absorbed therein. A lid portion closes the open top of the housing. The sponge portion of the tooth cleaning tool is positionable on the sterilizing pad to permit absorption of the sterilizing fluid by the sponge portion from the sterilizing pad.

9 Claims, 3 Drawing Sheets

TOOTH AND GUM CLEANING TOOL

BACKGROUND OF THE INVENTION

1. Field of the Invention

The present invention relates to tooth cleaning tools and more particularly pertains to a new tooth and gum cleaning tool for cleaning teeth and gums.

2. Description of the Prior Art

The use of tooth cleaning tools is known in the prior art. More specifically, tooth cleaning tools heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,273,425; U.S. Pat. No. 4,576,190; U.S. Pat. No. 2,583,750; U.S. Pat. No. 3,138,820; U.S. Pat. No. 5,639,445; and U.S. Pat. No. 5,044,041.

While these devices fulfill their respective, particular objectives and requirements, the aforementioned patents do not disclose a new tooth and gum cleaning tool. The inventive device includes an elongate handle portion having first and second ends. A sponge portion is coupled to said first end of said handle portion. The sponge portion has an engaging face and a back face opposite the engaging face. The engaging face has a plurality of uniformly spaced ridges extending from it.

In these respects, the tooth and gum cleaning tool according to the present invention substantially departs from the conventional concepts and designs of the prior art, and in so doing provides an apparatus primarily developed for the purpose of cleaning teeth and gums.

SUMMARY OF THE INVENTION

In view of the foregoing disadvantages inherent in the known types of tooth cleaning tools now present in the prior art, the present invention provides a new tooth and gum cleaning tool construction wherein the same can be utilized for cleaning teeth and gums.

The general purpose of the present invention, which will be described subsequently in greater detail, is to provide a new tooth and gum cleaning tool apparatus and method which has many of the advantages of the tooth cleaning tools mentioned heretofore and many novel features that result in a new tooth and gum cleaning tool which is not anticipated, rendered obvious, suggested, or even implied by any of the prior art tooth cleaning tools, either alone or in any combination thereof.

To attain this, the present invention generally comprises an elongate handle portion having first and second ends. A sponge portion is coupled to said first end of said handle portion. The sponge portion has an engaging face and a back face opposite the engaging face. The engaging face has a plurality of uniformly spaced ridges extending from it.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new tooth and gum cleaning tool apparatus and method which has many of the advantages of the tooth cleaning tools mentioned heretofore and many novel features that result in a new tooth and gum cleaning tool which is not anticipated, rendered obvious, suggested, or even implied by any of the prior art tooth cleaning tools, either alone or in any combination thereof.

It is another object of the present invention to provide a new tooth and gum cleaning tool which may be easily and efficiently manufactured and marketed.

It is a further object of the present invention to provide a new tooth and gum cleaning tool which is of a durable and reliable construction.

An even further object of the present invention is to provide a new tooth and gum cleaning tool which is susceptible of a low cost of manufacture with regard to both materials and labor, and which accordingly is then susceptible of low prices of sale to the consuming public, thereby making such tooth and gum cleaning tool economically available to the buying public.

Still yet another object of the present invention is to provide a new tooth and gum cleaning tool which provides in the apparatuses and methods of the prior art some of the advantages thereof, while simultaneously overcoming some of the disadvantages normally associated therewith.

Still another object of the present invention is to provide a new tooth and gum cleaning tool for cleaning teeth and gums.

Yet another object of the present invention is to provide a new tooth and gum cleaning tool which includes an elongate handle portion having first and second ends. A sponge portion is coupled to said first end of said handle portion. The sponge portion has an engaging face and a back face opposite the engaging face. The engaging face has a plurality of uniformly spaced ridges extending from it.

Still yet another object of the present invention is to provide a new tooth and gum cleaning tool that is gentler on sensitive gums than traditional bristled brushes.

Even still another object of the present invention is to provide a new tooth and gum cleaning tool that is less likely to cause receding gums than traditional bristled brushes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
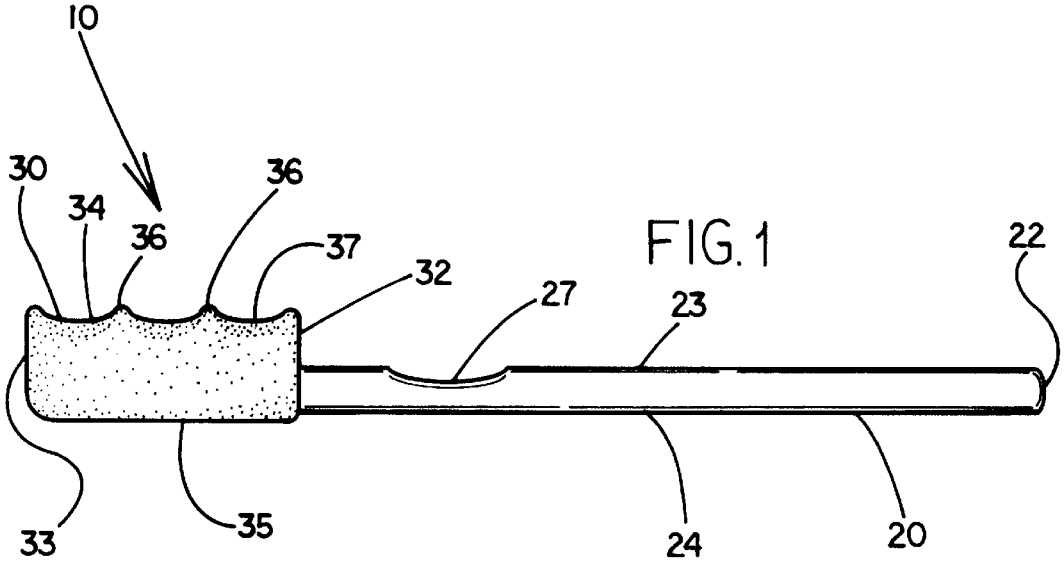
FIG. 1 is a schematic side view of a new tooth and gum cleaning tool according to the present invention.

With reference now to the drawings, and in particular to FIGS. 1 through 6 thereof, a new tooth and gum cleaning tool embodying the principles and concepts of the present invention and generally designated by the reference numeral 10 will be described.

As best illustrated in FIGS. 1 through 6, the tooth and gum cleaning tool 10 generally comprises an elongate handle portion 20 having first and second ends 21,22. A sponge portion 30 is coupled to the first end 21 of the handle portion 20. The sponge portion 30 has an engaging face 34 and a back face 35 opposite the engaging face 34. The engaging face 34 has a plurality of uniformly spaced ridges 36 extending from it.

Preferably, the sponge portion 30 has a plurality of interconnecting or open pores or cells through which a fluid may pass and be stored. This structure would also permit application of dental treatments to the teeth by saturating the sponge portion 30 and then rubbing the sponge portion 30 over teeth. The pores may also receive microorganisms, thereby removing them from the mouth. Ideally, the sponge portion 30 comprises polyurethane foam so that it is soft and pliable when wet while retaining some abrasive qualities.

Figure 2:
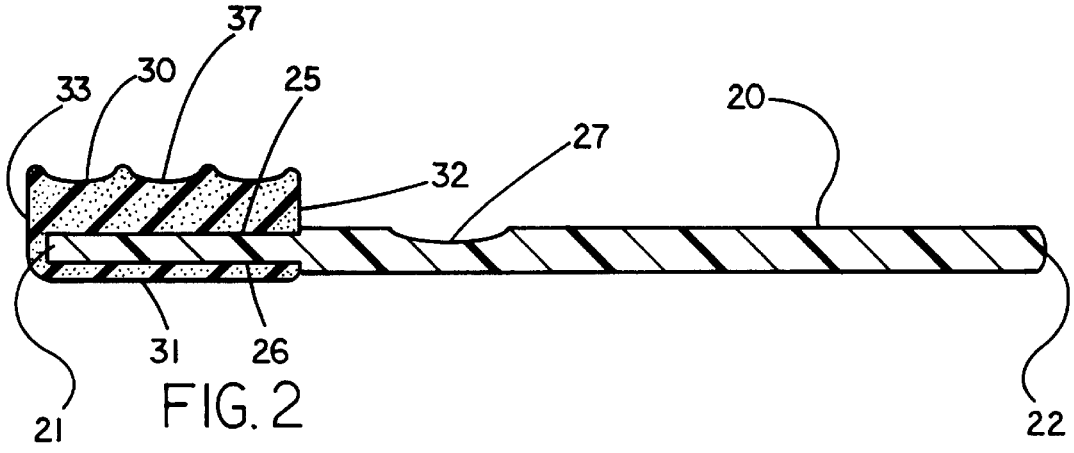
FIG. 2 is a schematic cross-sectional view of the present invention.
Figure 3:
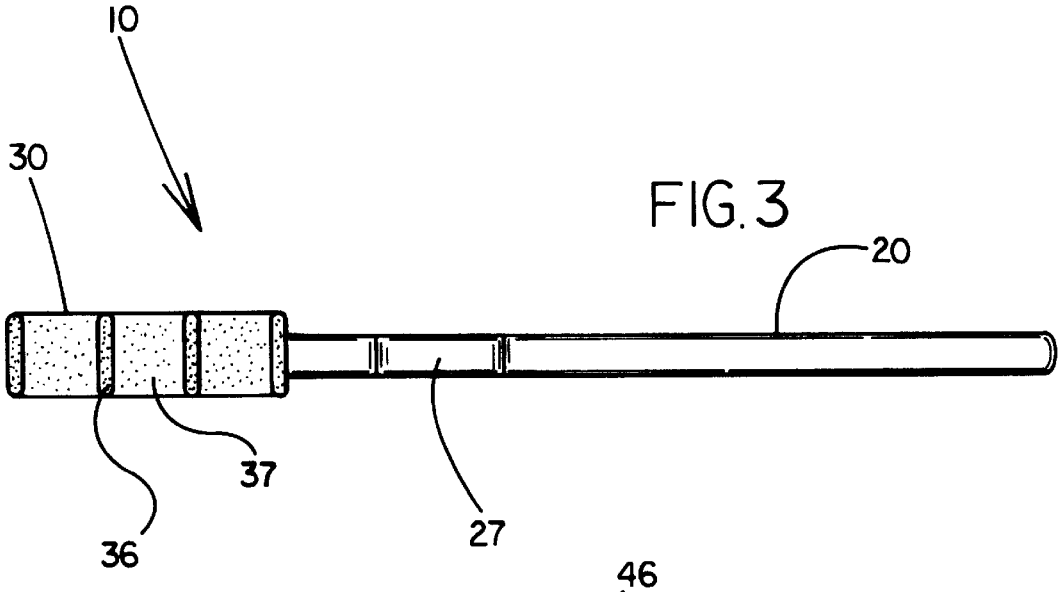
FIG. 3 is a schematic side view of the present invention.
Figure 4:
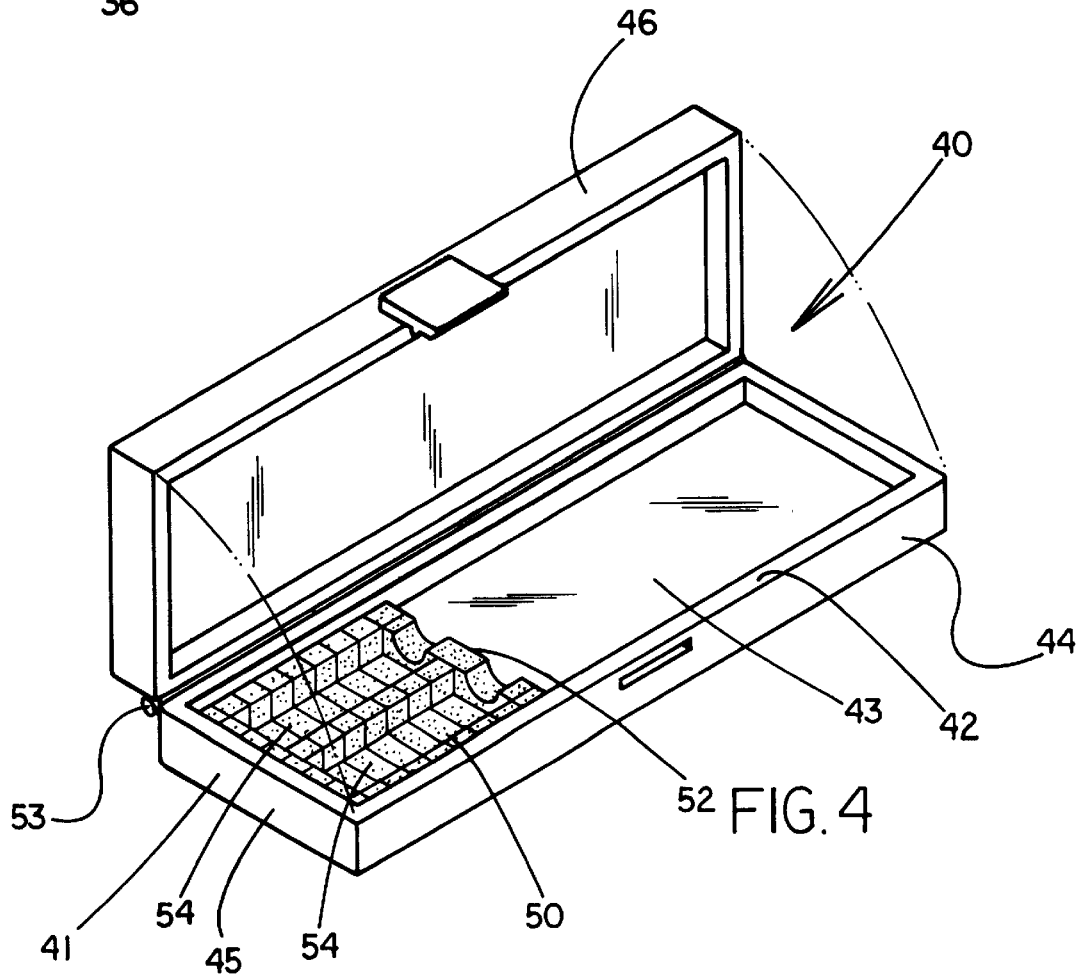
FIG. 4 is a schematic perspective view of a sterilization chamber of the present invention.

Preferably, as shown in FIG. 2, the sponge portion 30 has a handle receiving bore 31 extending into a proximal end 32 thereof. The first end 21 of the handle portion 20 is disposed in the handle receiving bore 31 of the sponge portion 30. Because the sponge portion 30 wraps completely around the first end 21 of the handle portion 20, the sponge portion 30 cushions contact with the gums, tongue and cheeks to prevent discomfort and injury, which can occur when the hard plastic handle of a traditional toothbrush strikes one of those areas.

The sponge portion 30 has an engaging face 34 and a back face 35 opposite the engaging face 34. The engaging face 34 has a plurality of uniformly spaced ridges 36 extending from it. A channel 37 is formed between adjacent pairs of the ridges 36 to wrap around a tooth to clean it. The ridges 36 should be spaced apart to generally conform to the spaces between the teeth so that they are more easily inserted in the spaces between the teeth to remove plaque and debris therefrom. Ideally, the engaging face 34 of the sponge portion 30 has four ridges 36.

Preferably, the handle portion 20 has upper and lower sides 23,24 that extend between the first and second ends 21,22 of the handle portion 20. The upper side 23 has a recessed portion 25,26 that extends from the first end 21 towards the second end 22. The lower side 24 has a recessed portion 25,26 that extends from the first end towards the second end. The recessed portions 25,26 permit the handle portion 20 to be thicker for comfort and strength while being narrower at the first end so that the sponge portion 30 is thicker around the handle portion 20, and therefore, less likely to tear during use.

Also preferably, the upper side 23 of the handle portion 20 has an arcuate finger channel 27 extending therein for receiving a finger to help prevent it from slipping along the handle portion 20.

A length of the handle portion 20 is defined between the first and second ends 21,22 thereof. The preferred length of the handle portion 20 is between about 5 and 9 inches, ideally about 7 9/16 inches. A length of the sponge portion 30 is defined between distal and proximal ends 33,32 thereof. The preferred length of the sponge portion 30 is between about ½ and 2½ inches, ideally about 1 3/16 inches.

Figure 5:
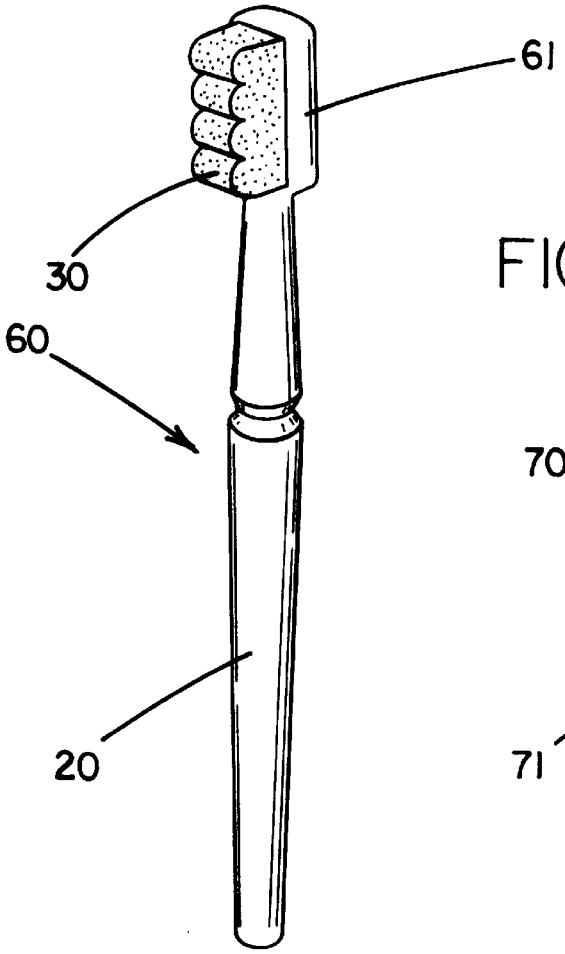
FIG. 5 is a schematic perspective view of an alternate embodiment of the present invention.
Figure 6:
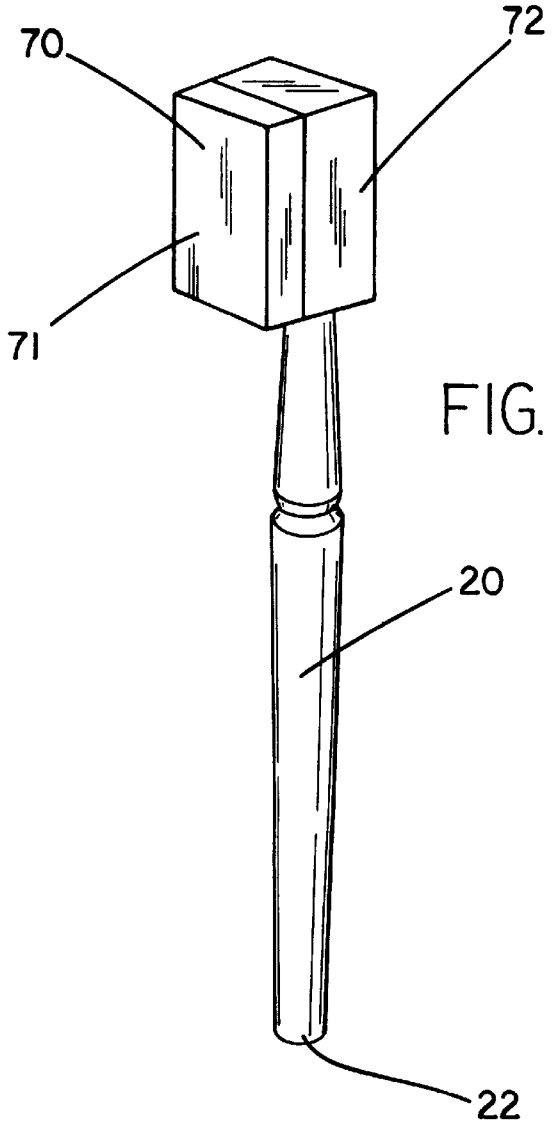
FIG. 6 is a schematic perspective view of an alternate embodiment of a cleaning device of the present invention.

Optionally, as shown in FIG. 5, a second cleaning tool 60 is provided. The second cleaning tool has a structure and dimensions substantially as set forth above, except that the first end of the handle portion has a widened head portion 61. The back face of the sponge portion is coupled to the head portion of the handle portion.

Preferably, a sterilization device 40 sterilizes the tooth cleaning tool. The sterilization device 40 comprises a housing 41 having an open top 42, a closed bottom 43, and an interior. A sterilizing pad 50 is disposed in the interior of the housing 41. The sterilizing pad 50 substantially extends between opposed lateral sides 44 of the housing 41 and is positioned toward a side end 45 of the housing 41. The sterilizing pad 50 is porous and has a sterilizing fluid absorbed therein. A lid portion 46 closes the open top 42 of the housing 41.

Also preferably, the sterilizing pad has a pair of channels 54 extending into an upper surface thereof. The sponge portion of the first tooth cleaning tool is positionable in one of the channels of the sterilizing pad for permitting absorption of the sterilizing fluid by the sponge portion from the sterilizing pad. The sponge portion of the second tooth cleaning tool being positionable in one of the channels of the sterilizing pad for permitting absorption of the sterilizing fluid by the sponge portion from the sterilizing pad.

Preferably, the sterilizing fluid sterilizes the sponge portion 30 in less than about 9 hours. More preferably, the sterilizing fluid comprises a solution of between about 1 and 5 percent glutaraldehyde. Ideally, the sterilizing fluid comprises a solution of about 2.5% glutaraldehyde.

A length of the housing 41 is defined between opposite side ends 45 thereof. The preferred length of the housing 41 is between about 5 and 10 inches and ideally about 8 inches. A width of the housing 41 is defined between opposite lateral sides 44 thereof. The width of the housing 41 is between about ½ and 2 inches, ideally about 1¼ inches.

Preferably, the sterilization pad is rectangular and has a forward edge (not shown) and a rearward edge 52 as well as a pair of opposite side edges 53. The length of the sterilization pad between the forward and rearward edges is between about 1 and 2 inches, ideally about 1½ inches. The length of the sterilization pad between the side edges 53 is between about ½ and 1¼ inch, ideally about ¾ inches.

Optionally, a second sterilization device 70 is provided for sterilizing the first and second tooth cleaning tools. The second sterilization device comprises a generally rectangular first casing portion 71 and a generally rectangular second casing portion 72. The sponge portion of the first or second tooth cleaning tools is positionable between the first and second casing portions. The first casing portion is detachably coupled to the second casing portion such that a seal is formed between the first and second casing portions and the handle portion of the first or second cleaning tool.

In use, the handle portion 20 is grasped and the sponge portion 30 is moved back and forth across the teeth and gums just as a traditional toothbrush is used. The sponge portion 30 removes plaque and debris from the teeth. After use, the cleaning tool 10 is placed in the sterilization chamber with the sponge portion 30 of the tool 10 resting on the sterilizing pad 50. The lid is closed. In about 8 hours, the cleaning tool 10 is sterilized. When necessary, more glutaraldehyde is added to the sterilizing pad 50 to resaturate As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tooth and gum cleaning system, comprising:

a cleaning tool comprising:

an elongate handle portion having first and second ends;

a sponge portion being coupled to said first end of said handle portion; and said sponge portion having an engaging face and a back face opposite said engaging face, said engaging face having a plurality of uniformly spaced ridges extending therefrom;

a sterilization device for sterilizing said tooth cleaning tool, said sterilization device comprising:

a housing having an open top, a closed bottom, and an interior;

a sterilizing pad being disposed in said interior of said housing, said sterilizing pad being porous and having a sterilizing fluid absorbed therein;

a lid portion for closing said open top of said housing;

said sponge portion of said tooth cleaning tool being positionable on said sterilizing pad for permitting absorption of said sterilizing fluid by said sponge portion from said sterilizing pad; and wherein said sterilizing pad has a channel extending into an upper surface thereof.

2. The tooth and gum cleaning system of claim 1, wherein said sterilizing pad substantially extends between opposed lateral sides of said housing and is positioned toward a side end of said housing.

3. The tooth and gum cleaning system of claim 1, wherein said sterilizing fluid sterilizes said sponge portion in less than about 9 hours.

4. The tooth and gum cleaning system of claim 1, wherein said sterilizing fluid comprises a solution of between about 1 and 5 percent glutaraldehyde.

5. The tooth and gum cleaning system of claim 1; wherein said sterilizing fluid comprises a solution of about 2.5% to glutaraldehyde.

6. The tooth and gum cleaning system of claim 1, wherein a length of said housing is defined between opposite side ends thereof, said length of said housing being between about 5 and 10 inches.

7. The tooth and gum cleaning system of claim 1, wherein a width of said housing is defined between opposite lateral sides thereof, said width of said housing being between about ½ and 2 inches.

8. The tooth and gum cleaning system of claim 1, wherein said sterilizing pad is rectangular and has forward and rearward edges and a pair of opposite side edges, a length of said sterilizing pad between said forward and rearward edges being between about 1 and 2 inches, a length of said sterilizing pad between said side edges being between about ½ and 1¼ inch.

9. A tooth and gum cleaning system, comprising:

a first cleaning tool for cleaning teeth and gums, comprising:

an elongate handle portion having first and second ends;

a sponge portion being coupled to said first end of said handle portion;

said sponge portion having a handle receiving bore extending into a proximal end thereof, said first end of said handle portion being disposed in said handle receiving bore of said sponge portion;

said sponge portion having an engaging face and a back face opposite said engaging face, said engaging face having a plurality of uniformly spaced ridges extending therefrom, a channel being formed between adjacent pairs of said ridges;

wherein said engaging face of said sponge portion has four ridges;

said handle portion having upper and lower sides being extended between said first and second ends of said handle portion, said upper side having a recessed portion extending from said first end towards said second end, said lower side having a recessed portion extending from said first end towards said second end;

said upper side of said handle portion having an arcuate finger channel extending therein for receiving a finger;

wherein a length of said handle portion is defined between said first and second ends thereof, said length of said handle portion being about 7 9/16 inches;

wherein a length of said sponge portion is defined between distal and proximal ends thereof, said length of said sponge portion being about 1 3/16 inches;

a second cleaning tool for cleaning teeth and gums, comprising:

an elongate handle portion having first and second ends;

said first end of said handle portion having a widened head portion;

a sponge portion having an engaging face and a back face opposite said engaging face, said back face of said sponge portion being coupled to said head portion of said handle portion;

said engaging face of said sponge portion having a plurality of uniformly spaced ridges extending therefrom, a channel being formed between adjacent pairs of said ridges;

wherein said engaging face of said sponge portion has four ridges;

said handle portion having upper and lower sides being extended between said first and second ends of said handle portion wherein a length of said handle portion is defined between said first and second ends thereof, said length of said handle portion being about 7 9/16 inches;

wherein a length of said sponge portion is defined between distal and proximal ends thereof, said length of said sponge portion being about 1 3/16 inches;

a first sterilization device for sterilizing said tooth cleaning tool, said first sterilization device comprising:

a housing having an open top, a closed bottom, and an interior;

a sterilizing pad being disposed in said interior of said housing, said sterilizing pad substantially extending between opposed lateral sides of said housing and positioned toward a side end of said housing, said sterilizing pad being porous and having a sterilizing fluid absorbed therein;

a lid portion for closing said open top of said housing;

said sterilizing pad having a pair of channels extending into an upper surface thereof;

said sponge portion of said first tooth cleaning tool being positionable in one of said channels of said sterilizing pad for permitting absorption of said sterilizing fluid by said sponge portion from said sterilizing pad;

said sponge portion of said second tooth cleaning tool being positionable in one of said channels of said sterilizing pad for permitting absorption of said sterilizing fluid by said sponge portion from said sterilizing pad;

wherein said sterilizing fluid sterilizes said sponge portions in less than about 9 hours;

wherein said sterilizing fluid comprises a solution of between about 1 and 5 percent glutaraldehyde;

wherein a length of said housing is defined between opposite side ends thereof, said length of said housing being about 8 inches;

wherein a width of said housing is defined between opposite lateral sides thereof, said width of said housing being about 1¼ inches; and wherein said sterilizing pad is rectangular and has forward and rearward edges and a pair of opposite side edges, the length of said sterilizing pad between said forward and rearward edges is between about 1 and 2 inches, the length of said sterilizing pad between said side edges is between about ½ and 1¼ inch;

a second sterilization device for sterilizing said first tooth cleaning tool, said second sterilization device comprising:

a generally rectangular first casing portion and a generally rectangular second casing portion;

said sponge portion of said first tooth cleaning tool being positionable between said first and second casing portions; and said first casing portion being detachably coupled to said second casing portion such that a seal is formed between said first and second casing portions and said handle portion of said first cleaning tool.

* * * * *